US006344717B1

(12) United States Patent
Lestician

(10) Patent No.: US 6,344,717 B1
(45) Date of Patent: Feb. 5, 2002

(54) HIGH FREQUENCY, HIGH EFFICIENCY ELECTRONIC LIGHTING SYSTEM WITH IODINE AND/OR BROMINE-BASED METAL HALIDE HIGH PRESSURE DISCHARGE LAMP

(75) Inventor: Guy J. Lestician, Smithfield, PA (US)

(73) Assignee: LightTech Group, Inc, Jamaica, NY (US)

( * ) Notice: Subject to any disclaimer, the term of this patent is extended or adjusted under 35 U.S.C. 154(b) by 0 days.

(21) Appl. No.: 09/689,256

(22) Filed: Oct. 12, 2000

(51) Int. Cl.[7] ..... G05F 1/00

(52) U.S. Cl. ..... 315/307; 315/291; 315/224; 315/209 R; 315/DIG. 7

(58) Field of Search ..... 315/307, 291, 315/224, 219, 289, 205, 209 R, 91, 119, 136, DIG. 4, DIG. 7; 313/571, 639–641

(56) References Cited

U.S. PATENT DOCUMENTS

| | | | | |
|---|---|---|---|---|
| 3,610,983 A | * 10/1971 | Grabner et al. | 313/25 |
| 4,232,252 A | * 11/1980 | Peil | 315/92 |
| 4,392,087 A | 7/1983 | Zansky | 315/219 |
| 4,717,863 A | 1/1988 | Zeiler | 315/307 |
| 4,876,485 A | 10/1989 | Fox | 315/244 |
| 4,937,470 A | 6/1990 | Zeiler | 307/270 |
| 5,039,920 A | 8/1991 | Zonis | 315/291 |
| 5,105,127 A | 4/1992 | Lavaud et al. | 315/291 |
| 5,287,040 A | 2/1994 | Lestician | 315/291 |
| 5,323,090 A | 6/1994 | Lestician | 315/291 |
| 5,900,701 A | 5/1999 | Guhilot et al. | 315/307 |
| 5,929,563 A | 7/1999 | Genz | 313/571 |

* cited by examiner

*Primary Examiner*—Haissa Philogene
(74) *Attorney, Agent, or Firm*—Kenneth P. Glynn

(57) ABSTRACT

The present invention is a high frequency, high efficiency start and quick restart system including a lamp. It includes hook ups for connecting and applying a power input to circuitry; a switch for switching a lamp on and off, and is connected to control power; auto-ranging voltage control circuitry; and a three stage power factor correction microchip controller. The microchip controller is a Bi-CMOS microchip. There is also a feedback current sensor; a power factor correction regulator; bulb status feedback; a bulb voltage controller; a conditioning filter; a half-bridge; a DC output inverter; and, output and connection for a metal-halide high-pressure discharge lamp which contains iodine, bromine or both, yttrium, an inert gas, halogen, thallium, hafnium, whereby hafnium can be replaced wholly or partially by zirconium, dysprosium and/or gadolinium as well as, optionally, cesium.

20 Claims, 11 Drawing Sheets

TO Fig. 7b
710
P2
720
T4
730
740
C4
33 nf
760
750
770
C9A
1 uf
J1
R13A 1K
790
R13 200 K
780
83
C13
1 uf
R14 22.6 K
R16 10 K
D13
81
R6 4.32 K
R7 4.32 K
R8 5.76 K
C18
47 uf
D18
D8
D7
Q1
Q4
R25 100Ω
79
150
R10 30Ω
C26
47 uf
C25
.22 uf
C23
6.8 uf
C24
470 pf
C21A
15 uf
R22 360 K
C22
1.5 uf
R26 5 K
R18 8.06 K
C26A
1.5 nf
R17 4.3 K
C19A
1 uf
C18A
1.5 nf
C4A
.33 nf
C17A
8.2 nf
C15A
82 nf
C29
100 pf
R15 581 K
75
R4 62 K
73
T1
D11
C7
R3 520Ω
D14
C5
C6
D16
D3
D4
D1
D2
77
R21 51.1 K
R19 16.2 K
U1
REF
Vcc
PFC_OUT
OUTA
OUTB
PGND
ACNO
RAMP
PWDET
RXCX
PVFB
PEAO
PIFB
PIFBO
LFB
LEAO
RSET
RT2
RT/CT
INTRPT
C3
.68 uf
C1
2.2 uf
C2
.012 uf
R1
.65Ω
2 W
D5
D6
R2A
470 Ω
CH1
CR1
CR2
E1
ACC1
BLACK
GREEN
WHITE
71

HIGH FREQUENCY, HIGH EFFICIENCY ELECTRONIC LIGHTING SYSTEM WITH IODINE AND/OR BROMINE-BASED METAL HALIDE HIGH PRESSURE DISCHARGE LAMP

BACKGROUND OF THE INVENTION

1. Field of the Invention

The present invention is directed to a system for quick restart of iodine and/or bromine-based metal halide high pressure discharge lamps. The system is a high frequency, high efficiency system which includes ballast features and utilizes a three stage power factor correction microchip in a unique circuit to achieve a diverse, superior device.

2. Information Disclosure Statement

The following patents represent the state of the art in ballast and lamp lighting systems:

U.S. Pat. No. 5,929,563 to Andreas Genz describes a metal-halide high-pressure discharge lamp with a discharge vessel and two electrodes which has an inside discharge vessel and ionizable filling, which contains yttrium (Y) in addition to inert gas, mercury, halogen, thallium (Tl), hafnium (Hf), whereby hafnium can be replaced wholly or partially by zirconium (Zr), dysprosium (Dy) and/or gadolinium (Gd) as well as, optionally, cesium (Cs). Preferably, the previously conventional quantity of the rare-earth metal is partially replaced by a molar equivalent quantity of yttrium. With this filling system, a relatively small tendency toward devitrification is obtained even with high specific arc powers of more than 120 W per mm of arc length or with high wall loads. Thus, the filling quantity of cesium can be clearly reduced relative to a comparable filling without yttrium, whereby an increase in the light flux and particularly in the brightness can be achieved.

U.S. Pat. No. 5,900,701 to Hansraj Guhilot et al. describes a lighting inverter which provides voltage and current to a gas discharge lamp in general and a metal halide lamp in particular with a novel power factor controller. The power factor controller step down converter having the device stresses of a buck converter, continuous current at its input like a CUK converter, a high power factor, low input current distortion and high efficiency. The inverter consists of two cyclically rotated CUK switching cells connected in a half bridge configuration and operated alternately. The inverter is further optimized by using integrated magnetics and a shared energy transfer capacitor. The AC voltage output from the inverter is regulated by varying its frequency. A ballast filter is coupled to the regulated output of the inverter. The ballast filter is formed by a series circuit of a ballast capacitor and a ballast inductor. The lamp is preferably connected across the inductor to minimize the acoustic arc resonance. The values of the capacitor and the inductor are chosen so as to satisfy the firing requirements of the HID lamps. A plurality of lamps are connected by connecting the multiple lamps with the ballast filters to the secondary of the inverter transformer. Almost unity power factor is maintained at the line input as well as the is lamp output.

U.S. Pat. No. 5,323,090 to Guy J. Lestician is directed to an electronic ballast system including one or more gas discharge lamps which have two unconnected single electrodes each. The system is comprised of a housing unit with electronic circuitry and related components and the lamps. The system accepts a.c. power and rectifies it into various low d.c. voltages to power the electronic circuitry, and to one or more high d.c. voltages to supply power for the lamps. Both the low d.c. voltages and the high d.c. voltages can be supplied directly, eliminating the need to rectify a.c. power. The device switches a d.c. voltage such that a high frequency signal is generated. Because of the choice of output transformers matched to the high frequency (about 38 kHz) and the ability to change frequency slightly to achieve proper current, the device can accept various lamp sizes without modification. The ballast can also dim the lamps by increasing the frequency. The device can be remotely controlled. Because no filaments are used, lamp life is greatly extended.

U.S. Pat. No. 5,287,040 to Guy J. Lestician is directed to an electronic ballast device for the control of gas discharge lamps. The device is comprised of a housing unit with electronic circuitry and related components. The device accepts a.c. power and rectifies it into various low d.c. voltages to power the electronic circuitry, and to one or more high d.c. voltages to supply power for the lamps. Both the low d.c. voltages and the high d.c. voltages can be supplied directly, eliminating the need to rectify a.c. power. The device switches a d.c. voltage such that a high frequency signal is generated. Because of the choice of output transformers matched to the high frequency (about 38 kHz) and the ability to change frequency slightly to achieve proper current, the device can accept various lamp sizes without modification. The ballast can also dim the lamps by increasing the frequency. The device can be remotely controlled.

U.S. Pat. No. 5,105,127 to Georges Lavaud et al. describes a dimming device, with a brightness dimming ratio of 1 to 1000, for a fluorescent lamp used for the backlighting of a liquid crystal screen which comprises a periodic signal generator for delivering rectangular pulses with an adjustable duty cycle. The pulses are synchronized with the image synchronizing signal of the liquid crystal screen. An alternating voltage generator provides power to the lamp only during the pulses. The decrease in tube efficiency for very short pulses allows the required dimming intensity to be achieved without image flickering.

U.S. Pat. No. 5,039,920 to Jerome Zonis describes a gas-filled tube which is operated by application of a powered electrical signal which stimulates the tube at or near its maximum efficiency region for lumens/watt output; the signal may generally stimulate the tube at a frequency between about 20 KHz and about 100 KHz with an on-to-off duty cycle of greater than one-to-one. Without limiting the generality of the invention, formation of the disclosed powered electrical signal is performed using an electrical circuit comprising a feedback transformer having primary and secondary coils, a feedback coil, and a bias coil, operatively connected to a feedback transistor and to a plurality of gas-filled tubes connected in parallel.

U.S. Pat. No. 4,937,470 to Kenneth T. Zeiler describes a gate driver circuit which is provided for push-pull power transistors. Inverse square wave signals are provided to each of the driver circuits for activating the power transistors. The combination of an inductor and diodes provides a delay for activating the corresponding power transistor at a positive transition of the control signal, but do not have a significant delay at the negative transition. This provides protection to prevent the power transistors from being activated concurrently while having lower power loss at high drive frequencies. The control terminal for each power transistor is connected to a voltage clamping circuit to prevent the negative transition from exceeding a predetermined limit.

U.S. Pat. No. 4,876,485 to Leslie Z. Fox describes an improved ballast that operates an ionic conduction lamp such as a conventional phosphor coated fluorescent lamp. The ballast comprises an ac/dc converter that converts an a-c power signal to a d-c power signal that drives a transistor tuned-collector oscillator. The oscillator is comprised of a high-frequency wave-shape generator that in combination with a resonant tank circuit produces a high-frequency signal that is equivalent to the resonant ionic frequency of the phosphor. When the lamp is subjected to the high frequency, the phosphor is excited which causes a molecular movement that allows the lamp to fluoresce and emit a fluorescent light. By using this lighting technique, the hot cathode of the lamp, which normally produces a thermionic emission, is used only as a frequency radiator. Therefore, if the cathode were to open, it would have no effect on the operation lamp. Thus, the useful life of the lamp is greatly increased.

U.S. Pat. No. 4,717,863 to Kenneth T. Zeilier describes a ballast circuit which is provided for the start-up and operation of gaseous discharge lamps. A power transformer connected to an inductive/capacitive tank circuit drives the lamps from its secondary windings. An oscillator circuit generates a frequency modulated square wave output signal to vary the frequency of the power supplied to the tank circuit. A photodetector feedback circuit senses the light output of the lamps and regulates the frequency of the oscillator output signal. The feedback circuit also may provide input from a remote sensor or from an external computer controller. The feedback and oscillator circuits produce a high-frequency signal for lamp start-up and a lower, variable frequency signal for operating the lamps over a range of light intensity. The tank circuit is tuned to provide a sinusoidal signal to the lamps at its lowest operating frequency, which provides the greatest power to the lamps. The ballast circuit may provide a momentary low-frequency, high power cycle to heat the lamp electrodes just prior to lamp start-up. Power to the lamps for start-up and dimming is reduced by increasing the frequency to the tank circuit, thereby minimizing erosion of the lamp electrodes caused by high voltage.

U.S. Pat. No. 4,392,087 to Zoltan Zansky describes a low cost high frequency electronic dimming ballast for gas discharge lamps is disclosed which eliminates the need for external primary inductance or choke coils by employing leakage inductance of the transformer. The system is usable with either fluorescent or high intensity discharge lamps and alternate embodiments employ the push-pull or half-bridge inverters. Necessary leakage inductance and tuning capacitance are both located on the secondary of the transformer. Special auxiliary windings or capacitors are used to maintain necessary filament heating voltage during dimming of fluorescent lamps. A clamping circuit or auxiliary tuned circuit may be provided to prevent component damage due to over-voltage and over-current if a lamp is removed during operation of the system.

Notwithstanding the prior art, the present invention is neither taught nor rendered obvious thereby.

SUMMARY OF THE INVENTION

The present invention is a high frequency, high efficiency quick restart system for lighting a particular type of bulb, including the bulb itself, namely, a unique iodine and/or bromine-based metal halide high pressure lamp. It includes ballast features and other aspects and has a base or housing unit to support circuitry and related components, e.g. one or more circuit boards or a combination of circuit boards, supports or enclosures. The electronic circuitry and components mounted on the housing unit, includes: means for connecting and applying a power input to the circuitry; switch means for switching a lamp on and off, which switch means control is connected to control power to the circuitry; and auto-ranging voltage control circuitry and components, including an auto line supply filter and a line voltage correction EMI to provide an auto-ranging voltage intake/output capability. There is also a three stage power factor correction microchip controller. This microchip controller is a Bi-CMOS microchip. There is a feedback current sensor; a power factor correction regulator; a bulb status feedback means; a bulb voltage controller; a conditioning filter; a half-bridge; a DC output inverter; and, output means and connection for a lamp. The means for connecting and applying a power input to the circuitry may have connection and adaption for receiving AC current and/or DC current. The three stage power factor correction microchip controller includes power detection means for end-of-lamp-life detection, a current sensing PFC section based on continuous, peak or average current sensing, and a low start up current of less than about 0.55 milliamps. In preferred embodiments, the three stage power factor correction microchip contains a three frequency control sequencer. Some of the features of the power factor correction microchip include power detect for end-of-lamp life detection; low distortion, high efficiency continuous boost, peak or average current sensing PFC section; leading edge and trailing edge synchronization between PFC and ballast; one to one frequency operation between PFC and ballast; programmable start scenario for rapid/instant start lamps; triple frequency controls network for dimming or starting to handle various lamp sizes; programmable restart for lamp out condition to reduce ballast heating; internal over-temperature shutdown; PFC over-voltage comparator to eliminate output runaway due to load removal; and low start up current.

In most preferred embodiments the three stage power factor correction microchip includes corrections for each of the following functions:

(1) inverting input to a PFC error amplifier and OVP comparator input;
(2) PFC error amplifier output and compensation mode;
(3) sense inductor current and peak current sense point of PFC cycle-by-cycle current limit;
(4) output of current sense amplified;
(5) inverting input of lamp error amplifier to sense and regulate lamp arc current;
(6) output lamp current error transconductance amplifier to sense and regulate lamp arc current;
(7) external resistor to set oscillator to $F_{max}$ and $R_x/C_x$ charging current;
(8) oscillator timing component to set start frequency;
(9) oscillator timing components;
(10) input for lamp-out detection and restart;
(11) resistance/capacitance to set timing for preheat and interrupt;
(12) timing set for preheat and for interrupt;
(13) integrated voltage for error amplifier output;
(14) analog ground;
(15) power ground;
(16) ballast MOSFET first drive/output;
(17) ballast MOSFET second drive/output;
(18) power factor MOSFET driver output;
(19) positive supply voltage; and,
(20) buffered output for specific voltage reference, e.g. 7.5 volt reference.

The power factor correction regulator in the present invention system is a power factor correction regulator with one MOSFET switching circuit, or two MOSFET switching circuits, and the DC output inverter is a DC output inverter with two MOSFET switching circuits, or four MOSFET switching circuits.

The lamp is a metal-halide high pressure discharge lamp with a discharge vessel and two electrodes. It contains an ionizable filling, which includes yttrium (Y) in addition to inert gas, mercury, either iodine or bromine or a combination thereof, thallium (Tl), hafnium (Hf), whereby hafnium can be replaced wholly or partially by zirconium (Zr), dysprosium (Dy) and/or gadolinium (Gd) as well as, optionally, cesium (Cs). Preferably, the previously conventional quantity of the rare-earth metal is partially replaced by a molar equivalent quantity of yttrium. With this filling system, a relatively small tendency toward devitrification is obtained even with high specific arc powers of more than 120 W per mm of arc length or with high wall loads. Thus, the filling quantity of cesium can be clearly reduced relative to a comparable filling without yttrium, whereby an increase in the light flux and particularly in the brightness can be achieved.

The system of the present invention not only illuminates these lamps well, but also provides for heretofore unachieved rapid restart capabilities.

In some preferred embodiments, the electronic circuitry and components switch means further includes dimmer circuitry and components.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
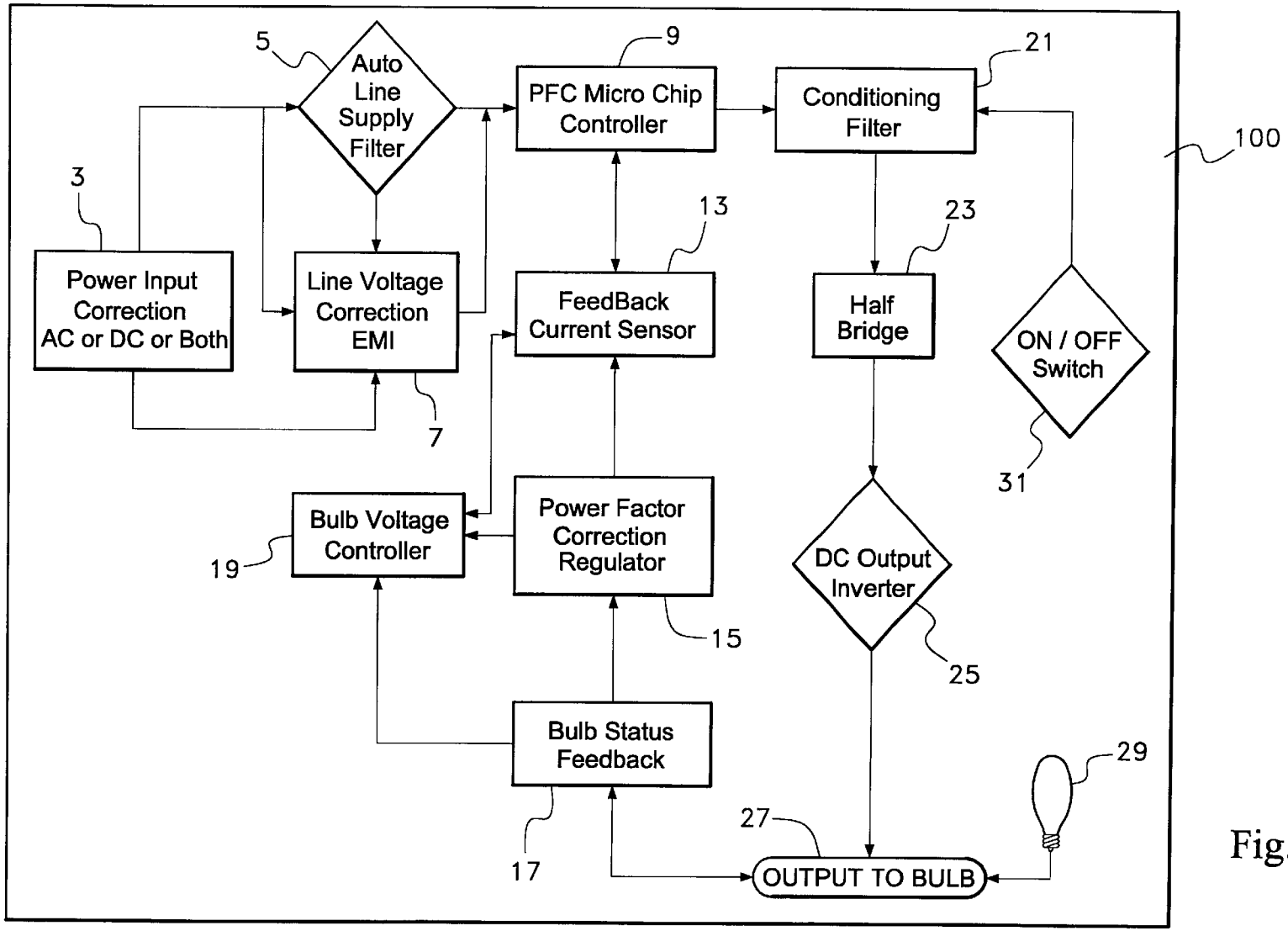
FIG. 1 shows a schematic diagram of the functional aspects of one preferred embodiment of the present invention high frequency, high efficiency quick restart electronic lighting system.

FIG. 1 shows a schematic diagram of the functional aspects of one preferred embodiment of the present invention high frequency, high efficiency quick restart electronic lighting system. Thus, housing unit 100 (a circuit board) is used to mount circuitry and related components. There is a power input connection 3 which is connected to both auto line supply filter 5 and line voltage correction EMI 7. These components cooperate to provide auto-ranging voltage control circuitry to assure that whatever power input 3 provides for power is corrected and/or converted before being fed to PFC microchip controller 9. The PFC microchip controller 9 is a three stage power factor correction controller described in more detail below. PFC microchip controller 9 is connected to feedback current sensor 13 and related components via feedback current sensor 13.

Power factor correction regulator 15 receives bulb status feedback 17 from output to bulb 27 and bulb 29. Additionally, feedback current sensor 13, power factor correction regulator 15 and bulb status feedback 17 are all connected to bulb voltage controller 19. These various components operate together and are controlled by PFC microchip controller 9.

PFC microchip controller 9 is also connected to conditioning filter 21, half bridge 23 and DC output inverter 25 to ultimately control output to bulb 27 to illuminate the aforementioned iodine and/or bromine-based metal halide high pressure bulb 29. Power is controlled by an on/off switch 31.

Figure 2:
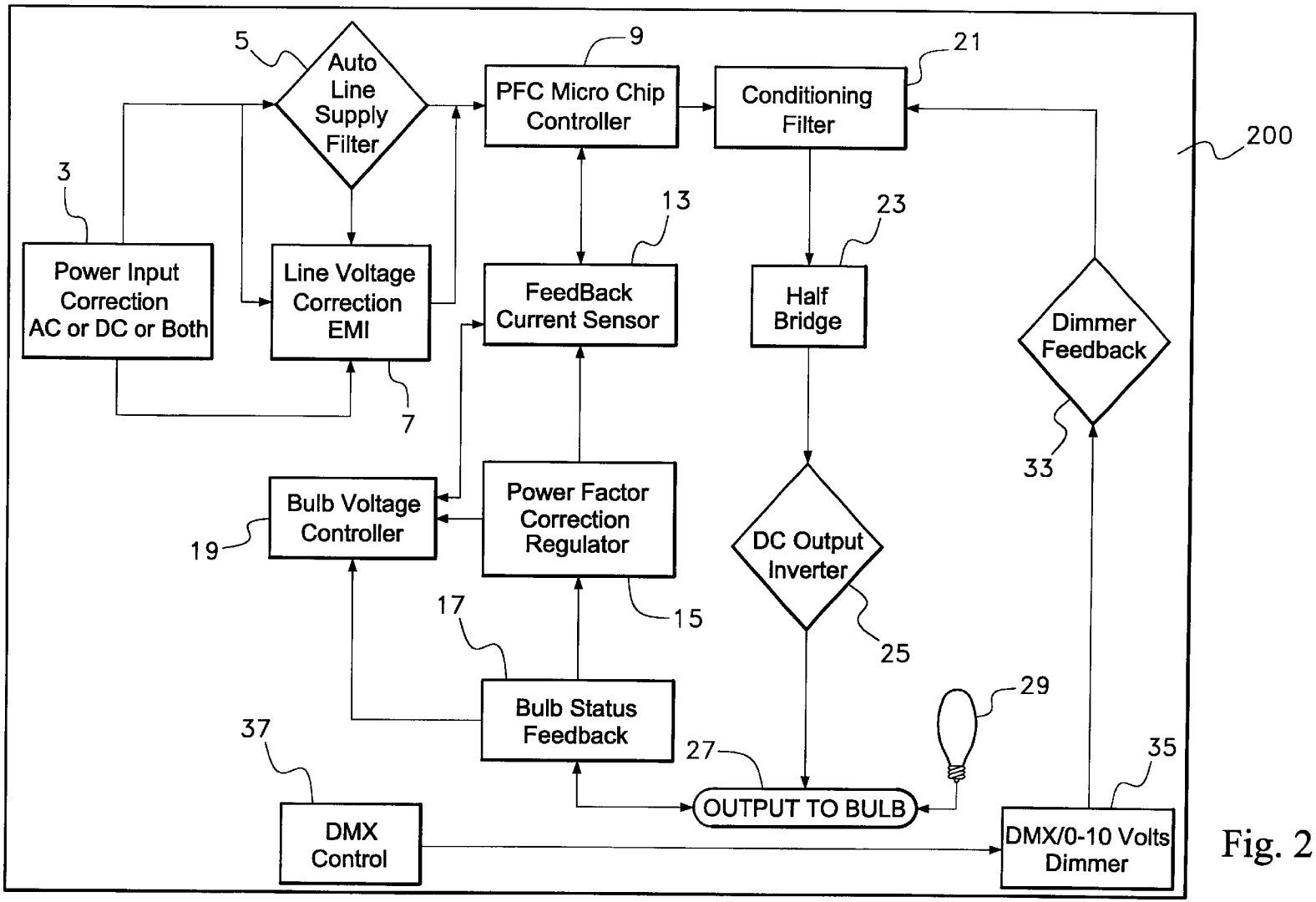
FIG. 2 shows a housing unit with circuitry which is similar to that shown in FIG. 1 except that dimmer features are included.

FIG. 2 shows housing unit 200 with circuitry which is similar to that shown in FIG. 1 except that on/off switch 31 has been replaced. Otherwise, identical parts have been identically numbered. In this embodiment, on/off switch 31 has been replaced with a dimming system which includes dimer 33, dimmer 35 and dimmer controller 37.

Alternatively, other dimmer arrangements, either manual or automatic (with timers or daylight sensitive or otherwise) may be used. However, as mentioned, dimming is an optional feature and is not used in some preferred embodiments.

Figure 3:
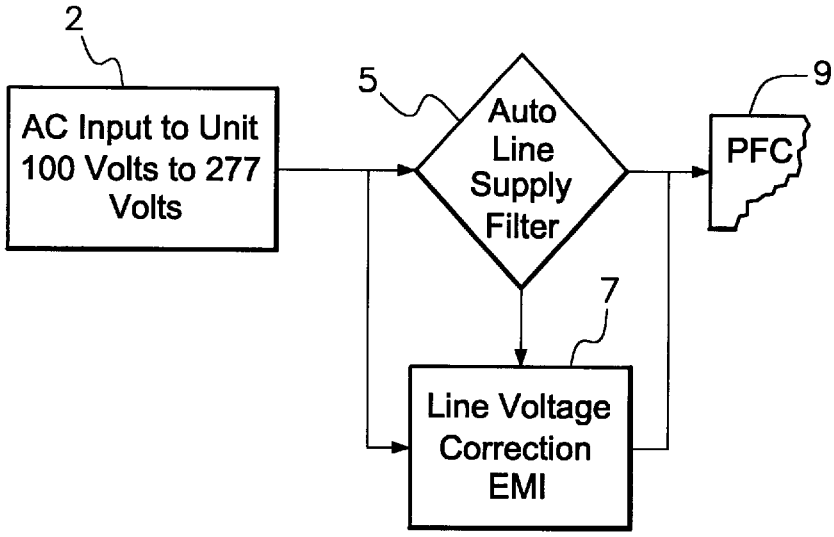
FIGS. 3, 4, and 5 show detailed partial views of the power input side of the systems shown in both FIGS. 1 and 2.
Figure 4:
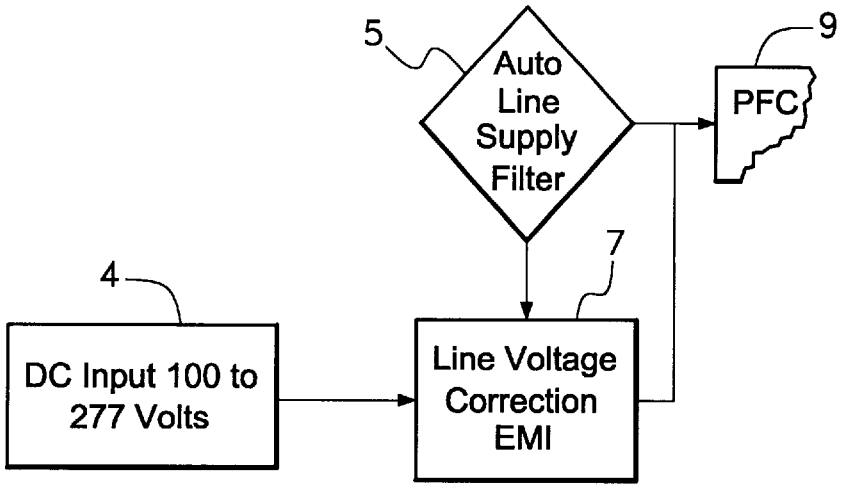
Figure 5:
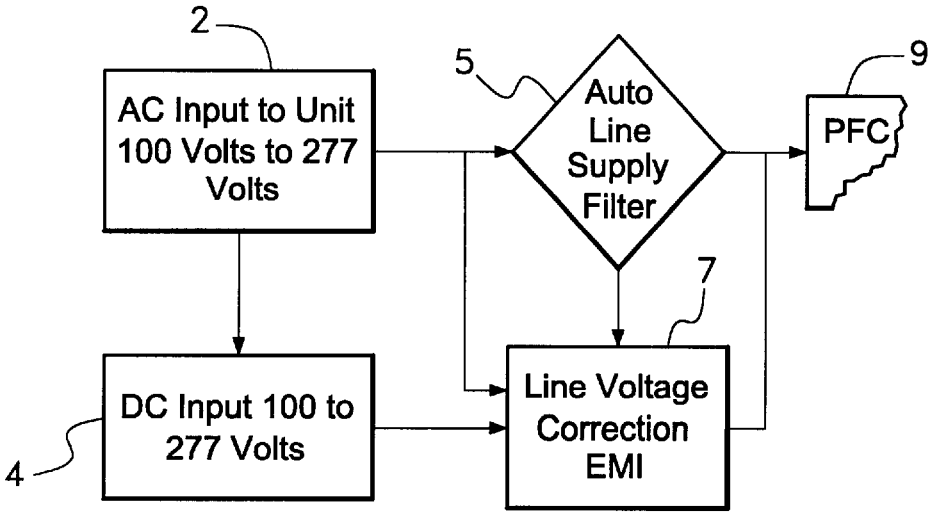

FIGS. 3, 4, and 5 show partial views of the power input side of the systems shown in both FIGS. 1 and 2. Components identical to those shown in FIGS. 1 and 2 are identically numbered. FIG. 3 shows alternating current input 2 which could carry from 100 volts to 277 volts and would function well, as designed. Alternatively, in FIG. 4, direct current input 4 could be employed at similar voltages. Thus, the present invention system could operate from 110 to 220 house current (AC) or otherwise, or could be connected to a battery, fuel cell or other direct current power source. Finally, a combination of both AC input 2 and DC input 4 may be employed as shown in FIG. 5.

Figure 6:
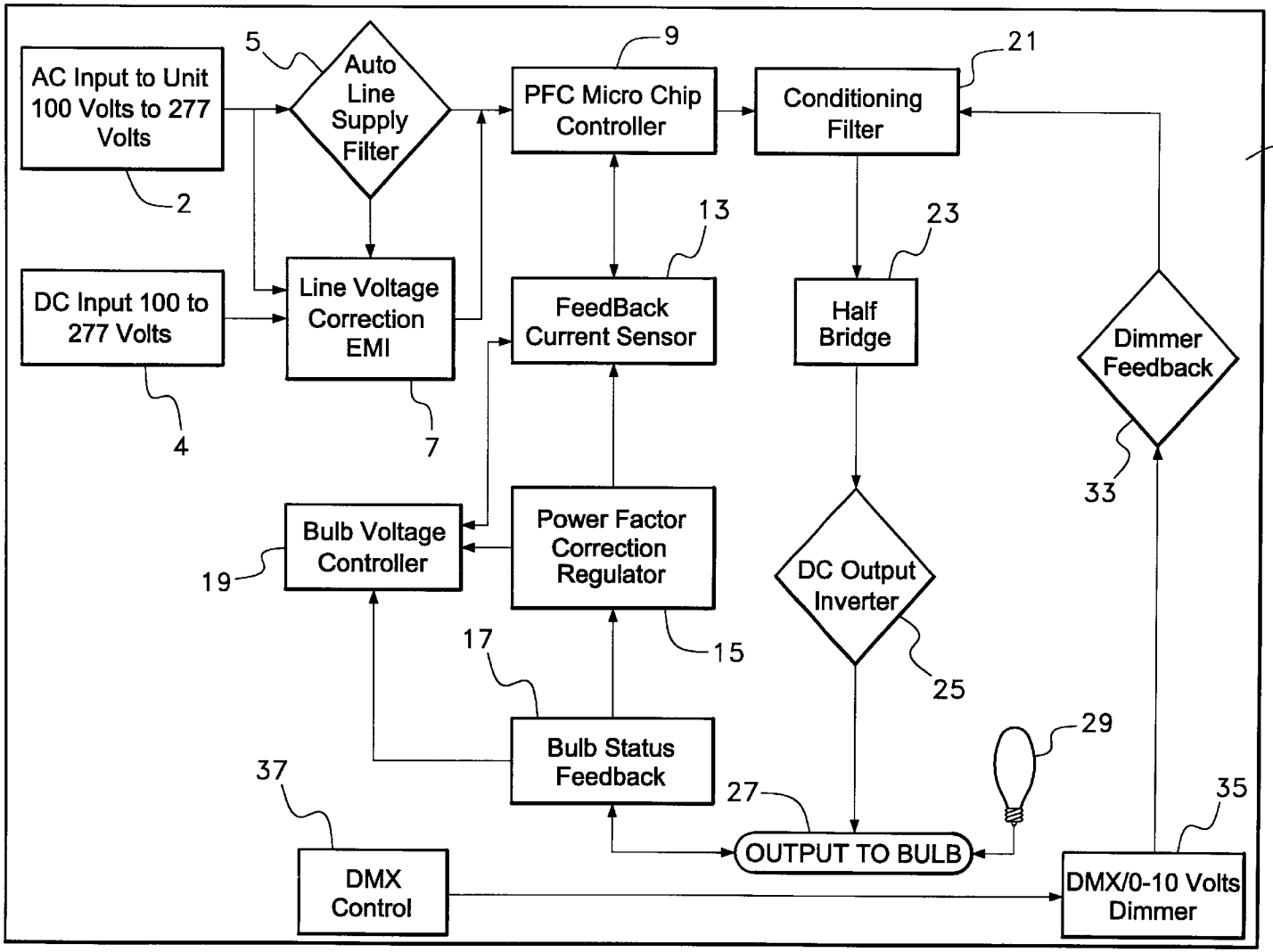
FIG. 6 illustrates a present invention device which represents a complete composite of the FIG. 2 embodiment with the FIG. 5 power input details.

FIG. 6 illustrates housing unit 300 which represents a complete composite of the FIG. 2 embodiment with the FIG. 5 power input details. Identical components are identically numbered.

Figure 7A:
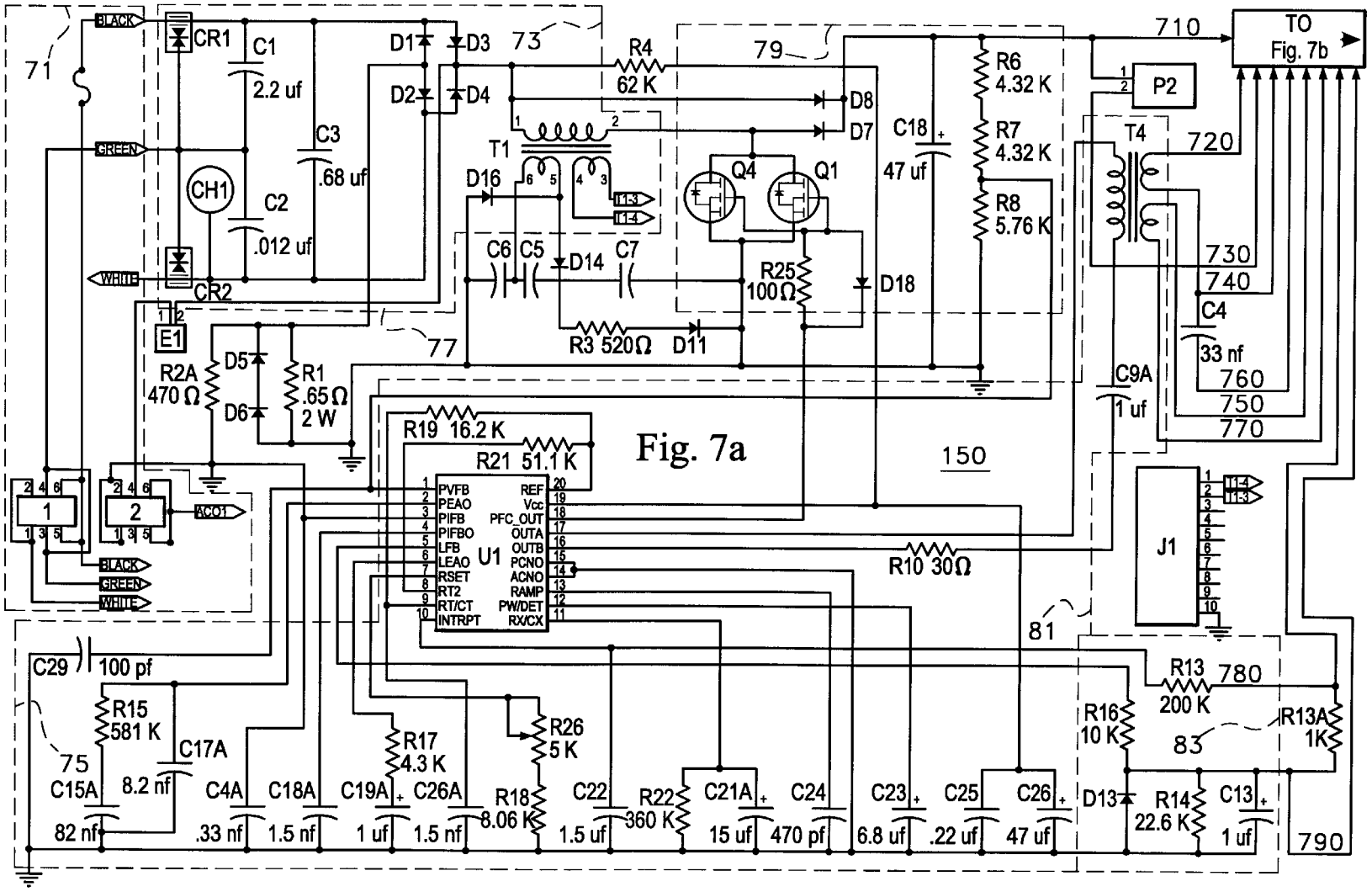
In FIGS. 7*a* and 7*b*, there is shown a complete wiring diagram of one preferred embodiment of the present invention device which corresponds to the FIG. 6 schematic representation.
Figure 7B:
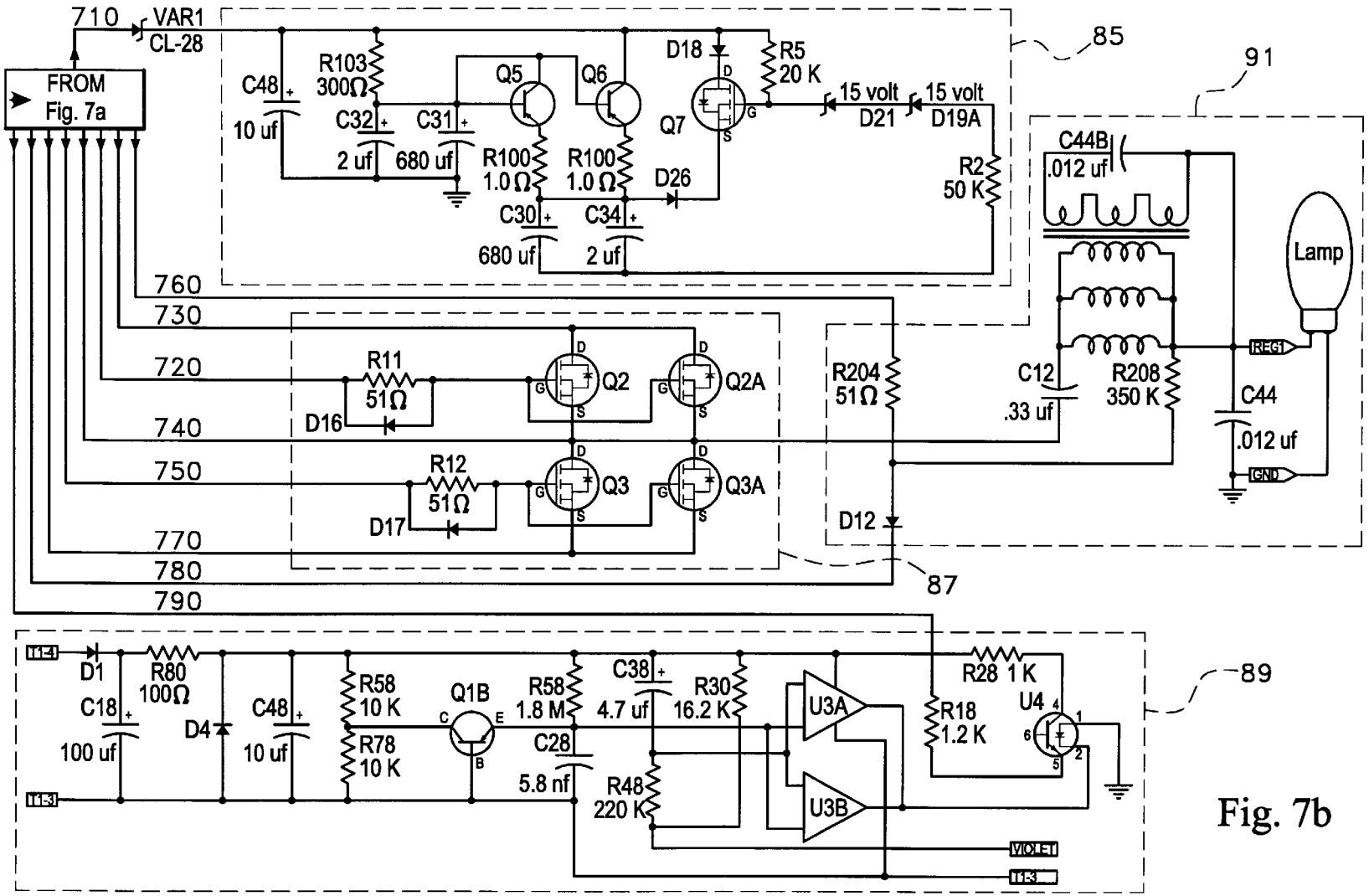

FIGS. 7*a* and 7*b* show a detailed wiring diagram for the present invention systems shown in FIG. 6. In FIGS. 7*a* and 7*b*, there is shown a complete wiring diagram of one preferred embodiment of the present invention which corresponds to the FIG. 6 schematic representation. In FIGS. 7*a* and 7*b* , standard electrical and electronic symbols are utilized and are self-explanatory to the artisan. There are dotted line areas which generally delineate functions which corresponds to FIG. 6. In FIG. 7*a*, block 71 represents power inputs, block 73 represents auto-ranging filter and line voltage correction EMI. Block 75 generally represents the PFC microchip controller and related functions; block 77 represents the feedback current sensor and block 79 represents the power factor correction regulator and related functions. Block 81 generally represents the bulb voltage control function and block 83 generally includes the bulb status feedback section. Connections 710, 720, 730, 740, 750, 760, 770, 780 and 790 shown in FIG. 7*a* are continuing and picked up in FIG. 7*b*, as shown.

Referring now to FIG. 7*b*, block 85 represents the conditioning filter function, block 87 generally represents the DC output inverter and block 89 represents the dimmer system. Finally, block 91 represents the bulb and output to the bulb.

Although the various components shown in FIGS. 7*a* and 7*b* exist, their arrangement is unique and creates surprising results. The PFC microchip controller is, as mentioned, a three stage power factor correction microchip which is shown as item 9 in FIGS. 1 through 6, as a single block.

The following table lists the various specific components and describes their ranges:

| Component and Reference | | Value (units) |
|---|---|---|
| 1N5408 | D2 D3 D4 D5 D8 | 1N5408J |
| SUF30J | D7 | SUF30J |
| TSD_74 | T3 | TSD-749 |
| M9648 | T4 | TDS-747 |
| ETD29 | T2 | ETD-29J |
| 2PIN-CNT | P1 | |
| 6-PIN-CNT | JP1 | |
| 10PIN-CNT | J1 | {10-Pin} |
| 10PIN-CNT | J2 | {10-Pin} |
| C1206 | D9 | 1N4148 |
| 8252N-CONCT | P1 | |
| C12NEW | C12 | .33 uf @ 400 v |
| C44A | C44 | .01 uf @ 1600 V |
| C1206 | D10 | 1N4148 |
| CAP100-SD | C5 C6 | .1 uf |
| CAP100-SD | C17 | 8.2 nf |
| CAP100-SD | C29 | 100 pf |
| CAP100-SMD | C25 | .22 uf |
| CAP100-SMD | C15 | 1 uf |
| CAP100-SMD | C18 | 1.5 nf |
| CAP100-SMD | C22 | 1.5 uf |
| CAP100-SMD | C23 | 6.8 uf |
| CAP100-SMD | C21 | 15 uf |
| CAP100-SMD | C4 | 33 nf |
| CAP100-SMD | C16 | 82 nf |
| CAP100-SMD | C24 | 470 pf |
| CAP200RP | C26 | 47 uf |
| CAP300 | C9 | 1 uf |
| CAP300 | C1 C2 | 2.2 nf |
| CAP300RP | C7 | 100 uf |
| CAP800 | C40 C41 | .01 uf |
| CAP875L | C3 | .47 uf |
| CAP1812N | C28 | 47 uf |
| CHASSISGND | CH2 | |
| CHASSISGND | CH1 | |
| D12 | D12 | 1n3937 |
| D13 | D13 | 5.5 v Zener |
| D16 | D16 | 1n4007 |
| D17 | D17 | 1n4007 |
| D18 | D18 | 1N4148 |
| DIODE1206A | D14 | 75 v Zener |
| FUSE | F1 | Fuse 2 amp |
| HEADER6 | P2 | 6-Pin |
| IRF840 | Q2 | IRF840 |
| IRF840 | Q1 | IRG4BC30UD |
| IRF840 | Q3 | IRG4BC30UD |
| ML4835 | U1 | ML4835N |
| PCAP450L875C | C10 | 47 uf |
| PHILIPS_SM | C11 | 680 PF |
| POT_BOURNS | R26 | 5 k ohms |
| PQ-TRANS | T1 | Transformer PF |
| R6 | R6 | 430 k ohms |
| R7 | R7 | 430 K ohms |
| R8 | R8 | 5.6 K ohms |
| R11 | R11 | 30 Ohm |

-continued

| Component and Reference | | Value (units) |
|---|---|---|
| R12 | R12 | 30 Ohm |
| R13 | R13A | 1 k ohm |
| R13A | R13 | 200 k ohm |
| R14 | R14 | 22 k ohm |
| R16 | R16 | 10 k ohm |
| R25 | R25 | 51 Ohm |
| R203 | R204 | 51 Ohm |
| R220 | R200 | 360 K ohm |
| RES1/8SMT | R18 | 8.2 k ohm |
| RES1/8SMT | R21 | 51.1 k ohm |
| RES1/8SMT | R22 | 360 k ohm |
| RES600 | R2 | 470 OHM |
| RES800 | R1 | 0.65 OHM 2 WATT |
| RES0SMT | R9 | 4.3 k ohm |
| RES-SMT | R17 | 4.3 k ohm |
| RES-SMT | R19 | 16.0 k ohm |
| RES-SMT | R24 | 20 k ohm |
| RES-SMT | R10 | 30 ohm |
| RES-SMT | R15 | 681 k ohm |
| RES-SMT | R3 | 820 OHM |
| RESISTOR400_1/4 | R4 | 62 K ohm |
| SMTDIODE2 | D11 | 15 v Zener |

In the above table, the references include a letter, wherein each represents a component in accordance with the following legend:

P=connector

C=capacitor

D=diode

J=connector

Q=mosfet

U=choke

R=resistor

CH=chasis ground

F=fuse.

Figure 8:
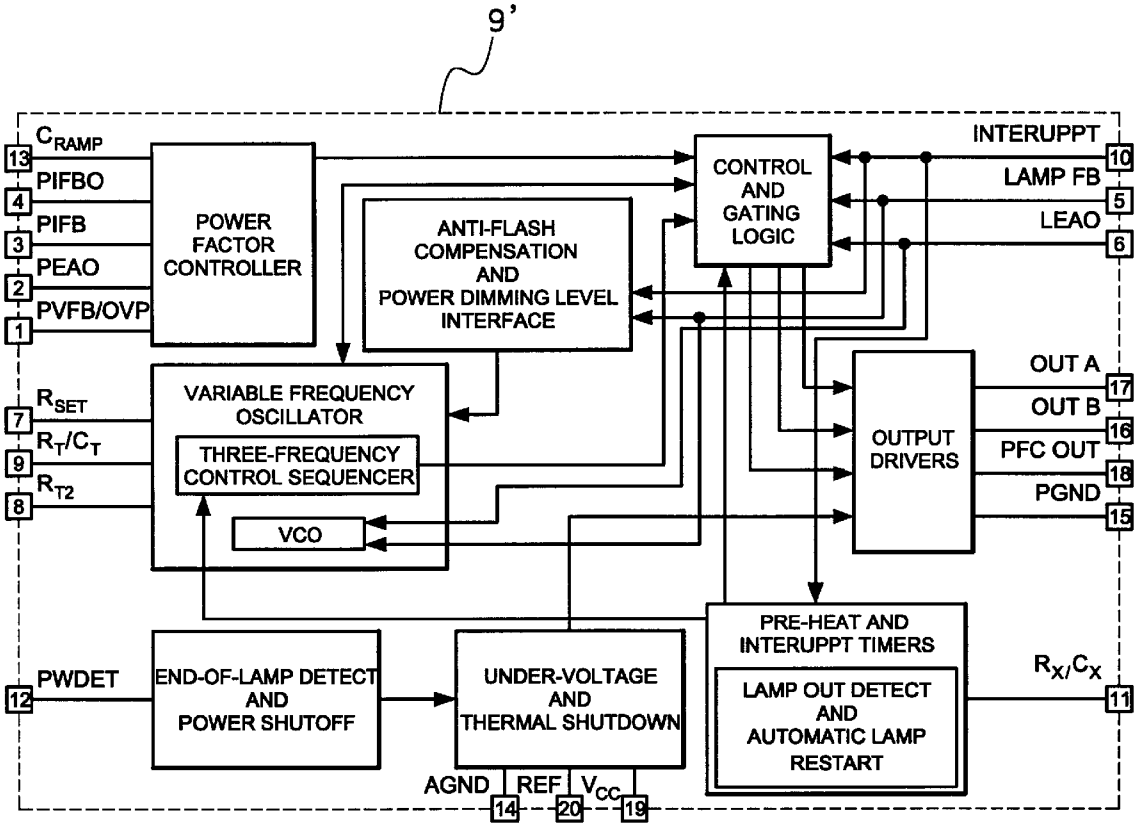
In FIG. 8, a PFC microchip controller is detailed in its functionality and in FIG. 9 it is shown by pin (connection), and in FIG. 10 it is shown by component details in block diagram form.

In FIG. 8, this microchip is detailed in its functionality and shown as chip 9'. It is also shown in FIG. 9 by pin (connection) arrangements as chip 9", and in FIG. 10 it is shown by component details in block diagram form, as chip 9'".

Figure 9:
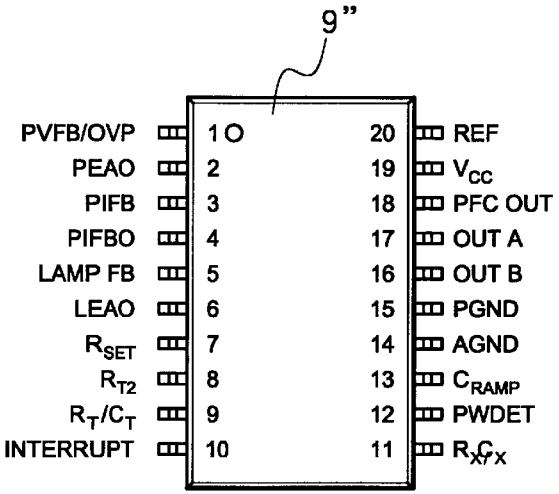
Figure 10:
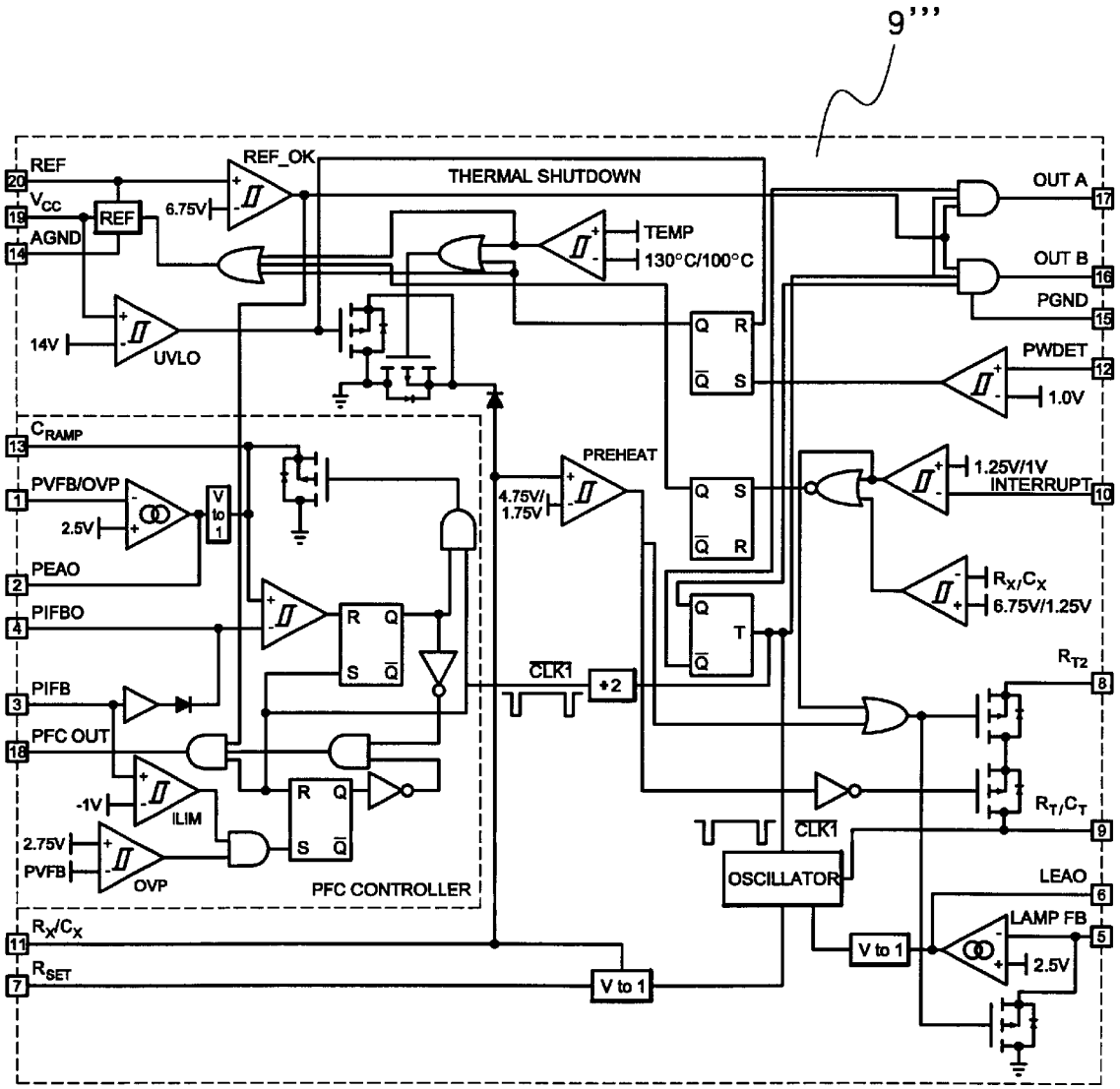

The following is a description of the pin numbers, names and functions for the 20 pins shown in FIGS. 8, 9 and 10:

| PIN | NAME | FUNCTION |
|---|---|---|
| 1. | PVFB/OVP | Inverting input to the PFC error amplifier and OVP comparator input. |
| 2. | PEAO | PFC error amplifier output and compensation node. |
| 3. | PIFB | Senses the inductor current and peak current sense point of the PFC cycle by cycle current limit. |
| 4. | PIFBO | Output of the current sense amplifier. Placing a capacitor to ground will average the inductor current. |
| 5. | LAMP FB | Inverting input of the lamp error amplifier, used to sense and regulate lamp arc current. Also the input node for dimmable control. |
| 6. | LEAO | Output of the lamp current error transconductance amplifier used for lamp current loop compensation. |

-continued

| PIN | NAME | FUNCTION |
|---|---|---|
| 7. | $R_{set}$ | External resistor which SETS oscillator $F_{MAX}$, and $R_x/C_x$ charging current. |
| 8. | $R_{T2}$ | Oscillator timing component to set start frequency. |
| 9. | $R_T/C_T$ | Oscillator timing component. |
| 10. | INTERRUPT | Input used for lamp-out detection and restart. A voltage less than 1 V will reset the IC and cause a restart after a programmable interval. |
| 11. | $R_x/C_x$ | Sets the timing for preheat and interrupt. |
| 12. | PWDET | Lamp output power detection. |
| 13. | $C_{RAMP}$ | Integrated voltage of the error amplifier out. |
| 14. | AGND | Analog ground. |
| 15. | PGND | Power ground. |
| 16. | OUT B | Ballast MOSFET driver output. |
| 17. | OUT A | Ballast MOSFET driver output. |
| 18. | PFC OUT | Power factor MOSFET driver. output |
| 19. | $V_{cc}$ | Positive supply voltage. |
| 20. | REF | Buffered output for the 7.5 V reference. |

The three stage microchip utilized in the present invention has all of the features set forth in FIGS. 8,9 and 10, and, while the microchip may be obtained "off the shelf" commercially, its use in the particular arrangements described herein and illustrated by FIG. 1 through 7*a* and 7*b* have neither been taught nor rendered obvious by the present invention. In fact, Micro Linear Corporation of San Jose, Calif. manufactures this chip as a compact fluorescent electronic dimming controller as product ML 4835. This microchip is, as mentioned, a three stage microchip which uses a first frequency for pre-start up heating, a second frequency for actual bulb start up and a third frequency for bulb illumination operation. Such chips are available from other manufacturers in addition to Micro Linear Corporation.

Figure 11:
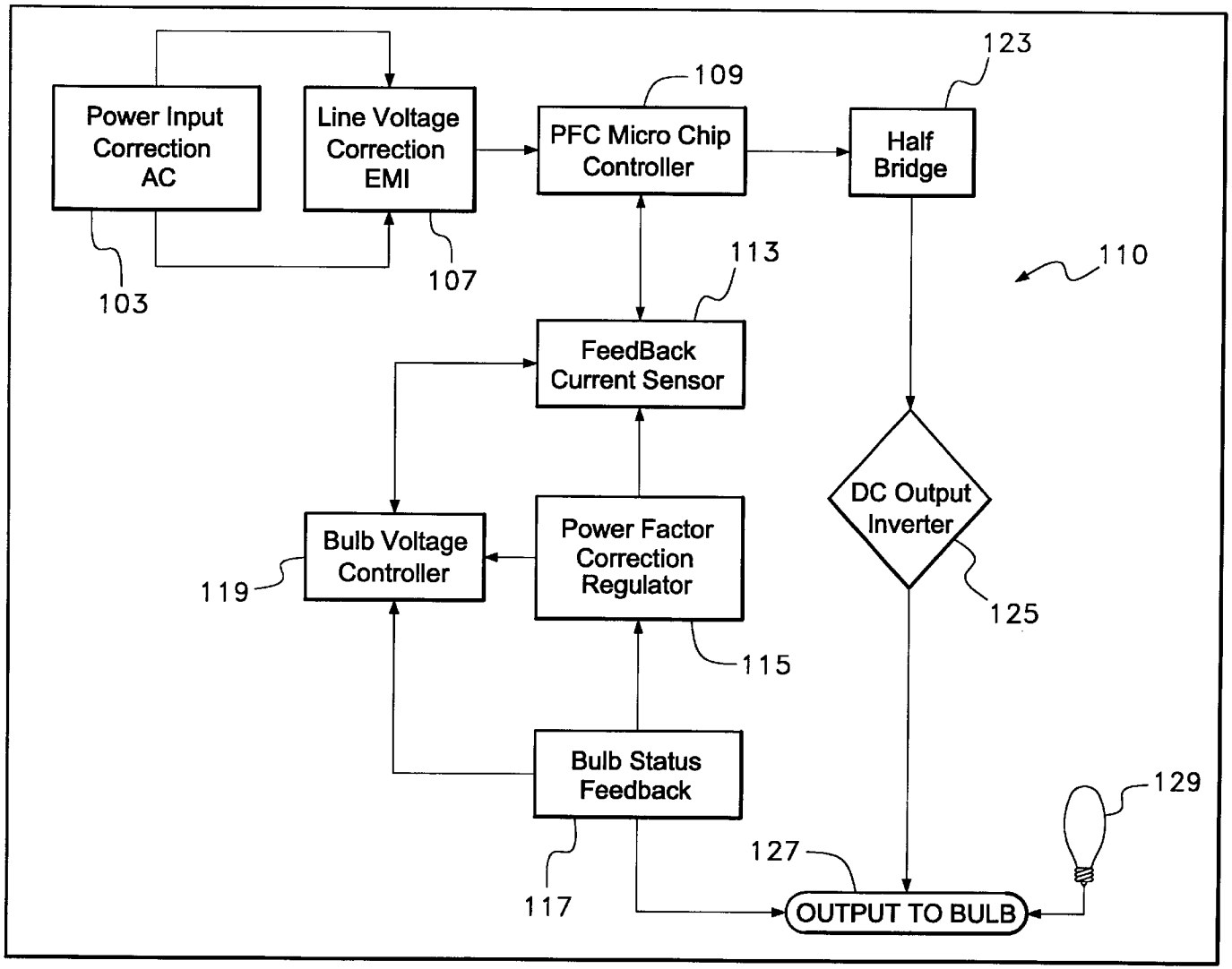
FIG. 11 illustrates another schematic diagram of a preferred embodiment alternating current power source-based high frequency, high efficiency quick restart electronic lighting system of the present invention.

FIG. 11 shows a schematic diagram of another preferred embodiment system, illustrating the functional aspects of a present invention high frequency, high efficiency quick restart electronic lighting system. Thus, housing unit 110 (a circuit board) is used to mount circuitry and related components. There is an AC power input connection 103 which is connected to line voltage correction EMI 107. These components cooperate to provide voltage control circuitry to assure that whatever power input 103 provides for power is corrected before being fed to PFC microchip controller 109. The PFC microchip controller 109 is a three stage power factor correction controller described in more detail above and below. PFC microchip controller 109 is connected to feedback current sensor 113 and related components via feedback current sensor 113.

Power factor correction regulator 115 receives bulb status feedback 117 from output to bulb 127 and bulb 129. Additionally, feedback current sensor 113, power factor correction regulator 115 and bulb status feedback 117 are all connected to bulb voltage controller 119. These various components operate together and are controlled by PFC microchip controller 109.

PFC microchip controller 109 is also connected to half bridge 123 and DC output inverter 125 to ultimately control output to bulb 127 to illuminate the aforementioned iodine and/or bromine-based metal halide high pressure bulb 129. Power may be controlled by an on/off switch, a computer or other mechanism (not shown).

Figure 12:
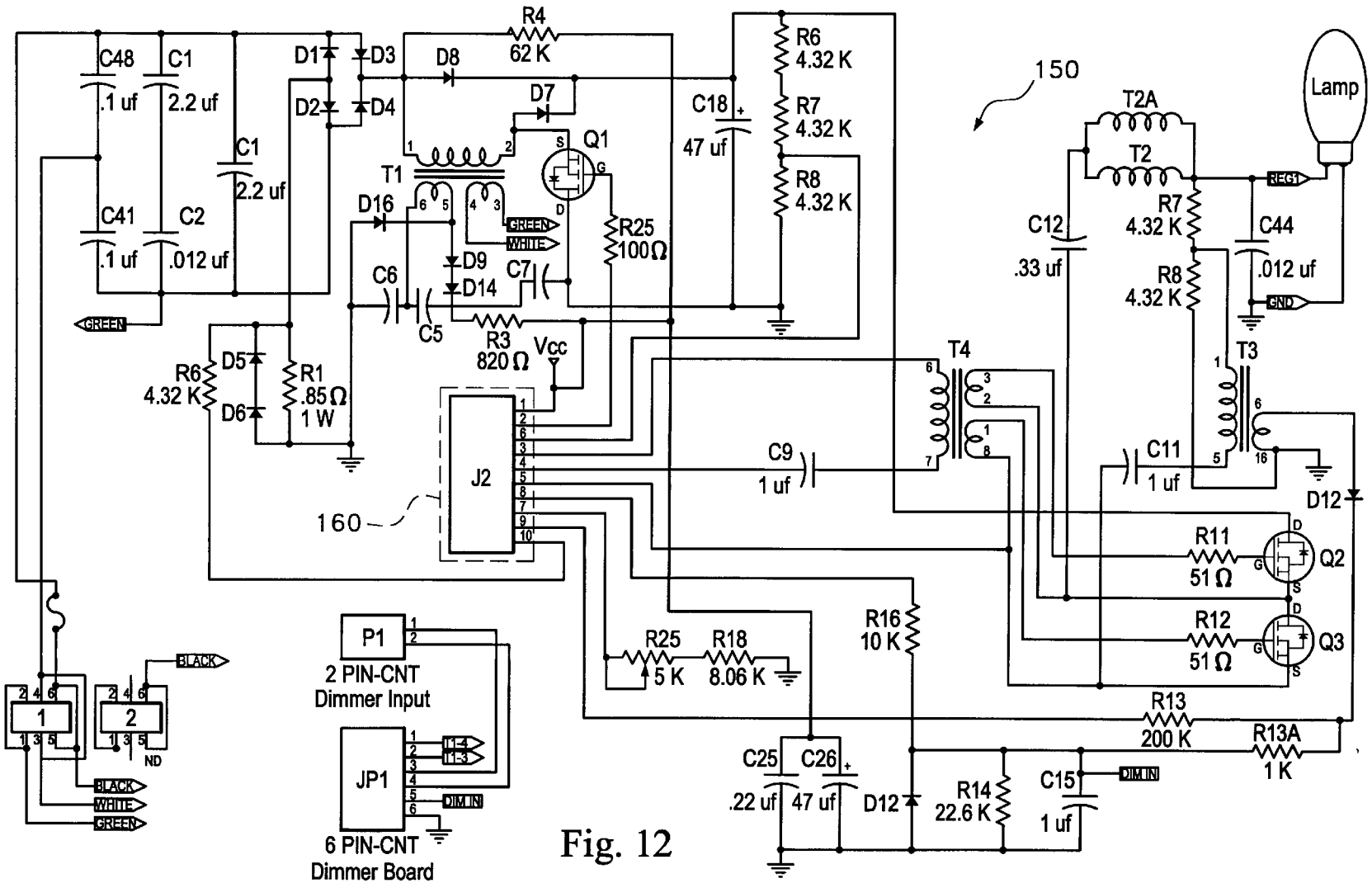
FIG. 12 shows a wiring diagram corresponding to the schematic diagram system shown in FIG. 11; and, FIG. 13 illustrates the details of the PFC microchip controller used in conjunction with the system shown in FIGS. 11 and 12.
Figure 13:
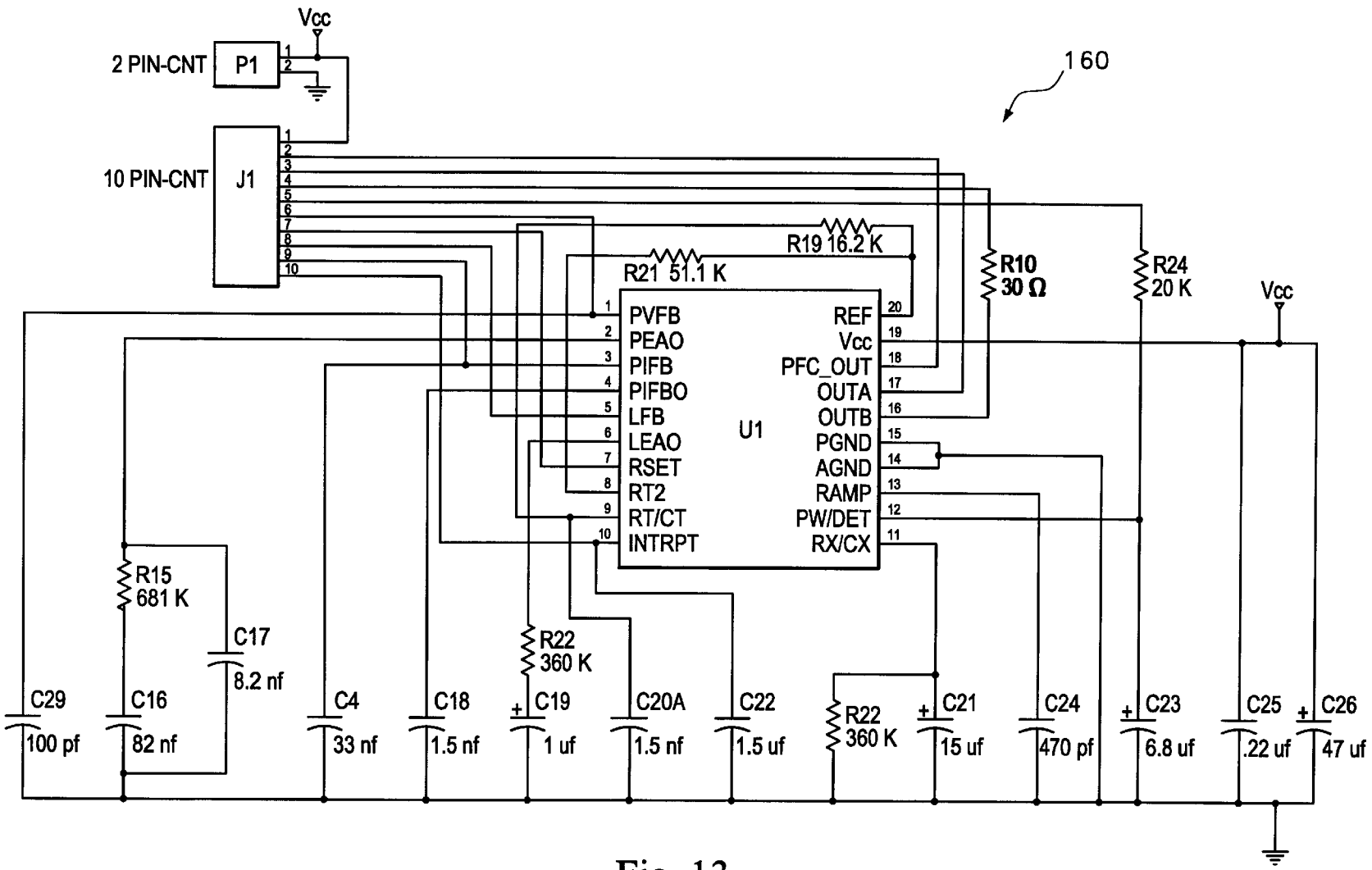

FIG. 12 shows a detailed wiring diagram of the system shown schematically in FIG. 11 above. A comparison of FIG. 6 and other figures above with FIG. 11 will readily reveal common components. All of the components in FIG. 11 are used in the FIG. 6 and the earlier figure schematics. Likewise, all of the detailed wiring diagram components shown generally as system 150 in FIG. 12 are shown in FIGS. 7*a* and 7*b* below and need not be discused in detail in duplicate as to FIG. 12. In other words, an artisan will now recognize the components of FIG. 12 by review of the foregoing Figures. Additionally, in FIG. 12, the block 160 generally represents the PFC microchip controller and related functions. This PFC microchip controller 160 is shown in detail in FIG. 13 . Again, values and components correspond to the foregoing teachings.

By the present invention system, the specialty high pressure, iodine and/or bromine-containing bulbs are started efficiently and economically and, very significantly, the present invention system has been utilized to illuminate these metal halide lamps, and to rapidly restart themin seconds. Thus, the present invention system performs unexpectedly and in a manner heretofore not seen, by quickly restarting these high pressure metal halide lamps. Typically, these high pressure sodium lamps are illuminated and shut down, a cool down period of at least 10 to 15 minutes is required, e.g. 20 minutes, before they can be restarted. With the present invention system, such lamps can be restarted in 30 seconds and typically in less than three seconds, without any difficulty or technical problems, and will have achieved more than 80% of its maximum lighting output within that start up time. In most preferred embodiments of the present invention this can be achieved in less than one second.

In the present invention, the iodine/bromine-based metal-halide high-pressure discharge lamp has a color temperature between 4000 K and 7000 K, a color rendition index $R_a$>80 and at the same time an improved devitrifying behavior relative to conventional metal halide lamps. Also, an increase in luminous flux and particularly brightness are achieved.

These objectivess are achieved by the provision of a metal-halide high-pressure discharge lamp with a conventional discharge vessel, two electrodes and an ionizable filling which contains at least one inert gas, mercury, at least one halogen, selected from iodine and bromine, and the following elements for the formation of the metal halides from the halogen(s): thallium (Tl), hafnium (Hf), whereby hafnium can be wholly or partially replaced by zirconium (Zr), as well as both, or one of the two, rare-earth metals (RE) dysprosium (Dy) and/or gadolinium (Gd), together with yttrium (Y) .

The basic concept of filling for the lamp, consists of adding yttrium (Y) in a targeted manner to the filling. It has been shown that the tendency toward devitrification can be reduced by this measure. The utilized luminous flux is reduced with increasing operating time of the lamp by devitrification of the lamp bulb, i.e., by the conversion from the glassy to the crystalline state. In addition, increasing devitrification reduces the service life, since the lamp bulb loses stability.

Further, the addition of yttrium opens up the possibility of reducing the quantity of cesium in the filling, or dispensing with cesium as a filling component entirely. This advantageous aspect of the invention is important for projection lamps. If the quantity of cesium is reduced in the filling, then on the one hand, the discharge arc increasingly contracts. Consequently, the brightness of the discharge arc that is important in projection techniques increases overproportionally in comparison to the increase in luminous flux. Thus, there is a great advantage of being able to reduce the filling quantity of cesium or in fact to dispense with cesium altogether, based on the addition of a corresponding quantity of yttrium.

A reduction in the filling quantity of cesium is desirable in and of itself since the light flux is reduced due to the cesium component in the filling. In the state of the art, however, this measure led unavoidably to a rapid and clear devitrification of the discharge vessel and was consequently not yet practical. Only by the addition of yttrium according to the invention is it generally possible to reduce the cesium component in highly loaded metal-halide discharge lamps, without unacceptably increasing devitrification at the same time.

For the case when cesium is entirely omitted in the filling, of course, an increased devitrification tendency must be taken into the bargain in the case of lamps with the yttrium addition according to the invention. Thus, cesium-free fillings will be selected only if maximum values for luminous flux and brightness have the highest priority.

In addition to the already named yttrium as well as the optional cesium, the ionizable filling of the discharge vessel also contains the following other elements for formation of the corresponding halides: thallium (Tl), hafnium (Hf), whereby the Hf can be entirely or partially replaced by zirconium (Zr), as well as both, or one of the two, rare-earth metals (RB) dysprosium (Dy) and/or gadolinium (Gd). Further, the filling still contains at least one inert gas, mercury (Hg) and at least one halogen. Preferably iodine (I) and/or bromine (Br) are used as halogens for forming the halides. The inert gas, e.g., argon (Ar) with a typical filling pressure of the order of magnitude of up to approximately 40 kPa serves for igniting the discharge. The desired arc-drop voltage is typically adjusted by Hg. Typical quantities for Hg lie in the range between approximately 10 mg and 30 mg per $cm^3$ of vessel volume for arc-drop voltages between 50 V and 100 V.

The molar filling quantities of Tl, Dy and, if necessary Gd typically amount to up to 15 $\mu$moles, up to 30 $\mu$moles or up to 0.6 $\mu$mole per $cm^3$ of vessel volume, respectively. The molar filling quantity of Hf and/or Zr lies in the region between 0.005 $\mu$moles and 35 $\mu$mole, preferably in the region between 0.05 $\mu$mole and 5 $\mu$moles per $cm^3$ of volume of the discharge vessel. The filling quantity of the optional Cs amounts to up to 30 $\mu$moles per $cm^3$ of the vessel volume, if needed.

A small devitrification tendency is produced with this filling system, despite high specific arc powers (typically>approximately 60 W per mm of arc length, particularly approximately 140 W per mm of arc length) or high wall loads.

A further advantage of this lamp is the possibility of utilizing the effect of yttrium, first of all, for a net reduction in the devitrification tendency with otherwise unchange light-technical properties, depending on the requirements of the lamp. On the other hand, however, the luminous flux or the brightness can be increased, with an otherwise unchanged tendency toward devitrification. It is also possible to take an intermediate path.

In the first variant, a part of the quantity of rare-earth metal that is common without yttrium, e.g. dysprosium, is replaced by a molar equivalent quantity of yttrium. Typical molar ratios between yttrium (Y) and the rare-earth metal(s) (RE) lie in the range of $0.5<Y/RE<2$. It is preferred that 50% of the quantity of the rare-earth metal or metals be replaced by a molar equivalent of yttrium. The molar ratio between yttrium and the rare-earth metal(s), e.g. dysprosium, thus preferably amounts to one.

In the case of the second variant, the quantity of cesium that is usual without yttrium is also reduced such that the devitrification tendency remains unchanged when compared with the filling without yttrium. Typically, the quantity of cesium can be reduced overproportionally in a molar comparison to the quantity of yttrium added.

For example, it has proven suitable to replace 50% of the quantity of rare-earth metal that has been common up to the present time by a molar equivalent of yttrium, and to cut in half the previously common quantity of cesium.

The discharge vessel is preferably operated within an outer bulb, which is evacuated for a particularly good color rendition. In order to increase the service life, the outer bulb contains a gas filling, for example, up to 70 kPa nitrogen ($N_2$) or up to 40 kPa carbon dioxide ($CO_2$), whereby the color rendition is, of course, somewhat reduced.

The following represents two different fillings of the lamp in the present invention system. The filling quantities each time were selected in these examples so that the devitrification tendency is the same for both fillings. In filling I, the filling is without yttrium according to the state of the art. Filling II, on the other hand, is a filling of a lamp within the present invention system. Here, half of the original quantity of dysprosium is replaced by a molar equivalent quantity of yttrium. In addition, the filling quantity of cesium is reduced by one half in comparison to filling I. As Table 4 reported in U.S. Pat. No. 5,929,563 shows, an approximately 4% higher luminous flux ($\Phi$) as well as an approximately 17% higher brightness (L) is obtained with filling II according to the present invention system lamps.

TABLE 1

Metal-halide composition of the lamp of FIG. 1.

| Component | Quantity in mg |
|---|---|
| CsI | 0.4 |
| TlI | 0.25 |
| Dy | 0.21 |
| Y | 0.11 |
| Hf | 0.14 |
| $HgI_2$ | 2.6 |
| $HgBr_2$ | 3.4 |

TABLE 2

Molar quantities of the most important filling components of Table 1.

| Component | Quantity in $\mu$mole | Quantity in $\mu$mole/$cm^3$ |
|---|---|---|
| Cs | 1.54 | 0.440 |
| Tl | 0.75 | 0.216 |
| Dy | 1.29 | 0.369 |
| Y | 1.24 | 0.354 |
| Hf | 0.78 | 0.224 |

TABLE 3

| Light-technical values obtained with the filling of Table 1 | |
|---|---|
| Luminous flux in lm | 48000 |
| Luminous Efficacy in lm/W | 84 |
| Color temperature in K | 6000 |
| $R_a$ | 85 |
| $R_g$ | >50 |
| Service life in h | >1000 |

TABLE 4

Comparison of the light-technical values obtained with two different fillings and the lamp in FIG. 1

| | Filling I (State of the Art) | Filling II (Invention) |
|---|---|---|
| Cy in $\mu$mole | 1 | 0.5 |
| Y in $\mu$mole | — | 0.5 |
| Cs in $\mu$mole | 1.2 | 0.6 |
| in klm | 47 | 49 |
| L in ked/cm$^2$ | 30 | 35 |

Obviously, numerous modifications and variations of the present invention are possible in light of the above teachings. It is therefore understood that within the scope of the appended claims, the invention may be practiced otherwise than as specifically described herein.

What is claimed is:

1. A high frequency, high efficiency electronic system for lighting, which comprises:

(a) a housing unit to mount electronic circuitry and related components;

(b) electronic circuitry and components mounted on said housing unit, which includes:

(i) means for connecting and applying a power input to said circuitry;

(ii) switch means for switching a lamp on and off, which switch means is connected to control power to said circuitry;

(iii) auto-ranging voltage control circuitry and components, including an auto line supply filter and a line voltage correction EMI to provide an auto-ranging voltage intake/output capability;

(iv) a three stage power factor correction microchip controller, said microchip controller being a Bi-CMOS microchip;

(v) a feedback current sensor;

(vi) a power factor correction regulator;

(vii) lamp status feedback means;

(viii) a lamp voltage controller;

(ix) a conditioning filter;

(x) a half-bridge;

(xi) a DC output inverter; and, (xii) output means and connection for a lamp; and, (c) a metal-halide high-pressure discharge lamp which includes a discharge vessel having a cavity, two electrodes operatively positioned within said cavity, and an ionizable filling within said cavity, said filling comprising at least one inert gas, mercury, at least one halogen selected from bromine, iodine and mixtures thereof, and the following elements for the formation of halides: thallium, hafnium, whereby hafnium can be wholly or partially replaced by zirconium, and a rare earth metal selected from the group consisting of dysprosium and/or gadolinium, said fill further including yttrium, said lamp being connectable to said output means and connection.

2. The system of claim 1 wherein the molar ratio between yttrium and the rare-earth metal(s) lies in the range 0.5<Y/RE<2.

3. The system of claim 2 wherein said molar ratio between yttrium and the rare-earth metal(s) is about one.

4. The system of claim 1 wherein said filling contains a quantity of dysprosium up to 30 $\mu$moles per cm$^3$ of the volume of said cavity of said discharge vessel.

5. The system of claim 1 wherein said filling contains a quantity of gadolinium in the range between 0 $\mu$mole and 0.6 $\mu$mole per cm$^3$ of the volume of said cavity of said discharge vessel.

6. The system of claim 1 wherein said filling contains up to 30 $\mu$moles of cesium per cm$^3$ of the volume of the cavity of said discharge vessel.

7. The system of claim 1 wherein said filling contains a quantity of thallium up to 15 $\mu$moles per cm$^3$ of the volume of the cavity of said disharge vessel.

8. The system of claim 1 wherein said filling contains hafnium and/or zirconium in the range between 0.005 $\mu$mole and 35 $\mu$moles per cm$^3$ of the volume of the cavity of said discharge vessel.

9. The system of claim 1 wherein said electrodes of said discharge vessel define therebetween a given arc length and said lamp operates with a specific arc power of about 80 to 120 W per mm of said given arc length.

10. The system of claim 1 wherein said halogens include at least iodine.

11. The system of claim 10 wherein said halogen is iodine.

12. The system of claim 1 wherein said means for connecting and applying a power input to said circuitry has connection and adaption for receiving either AC current or DC current.

13. The high frequency, high efficiency system of claim 1 wherein said three stage power factor correction microchip controller includes power detection means for end-of-lamp-life detection, a current sensing PFC section based on continuous, peak or average current sensing, and a low start up current of less than about 0.55 milliamps.

14. The system of claim 13 wherein said three stage power factor correction microchip contains a three frequency control sequencer.

15. The system of claim 14 wherein said three stage power factor correction microchip includes corrections for each of the following functions:

(1) inverting input to a PFC error amplifier and OVP comparator input;

(2) PFC error amplifier output and compensation mode;

(3) sense inductor current and peak current sense point of PFC cycle-by-cycle current limit;

(4) output of current sense amplified;

(5) inverting input of lamp error amplifier to sense and regulated lamp arc current;

(6) output lamp current error transconductance amplifier to sense and regulate lamp arc current;

(7) external resistor to set oscillator to $F_{max}$ and $R_x/C_x$ charging current;

(8) oscillator timing component to set start frequency;

(9) oscillator timing components;

(10) input for lamp-out detection and restart;

(11) resistance/capacitance to set timing for preheat and interrupt;

(12) timing set for preheat and for interrupt;

(13) integrated voltage for error amplifier output;

(14) analog ground;

(15) power ground;

(16) ballast MOSFET first drive/output;

(17) ballast MOSFET second drive/output;

(18) power factor MOSFET driver output;

(19) positive supply voltage; and,

(20) buffered output for specific voltage reference.

16. The system of claim 1 wherein said power factor correction regulator is a power factor correction regulator selected from the group consisting of those having one MOSFET switching circuit, and those having two MOSFET switching circuits.

17. The system of claim 1 wherein said DC output inverter is a DC output inverter selected from the group consisting of those having two MOSFET switching circuits, and those having four MOSFET switching circuits.

18. The system of claim 1 wherein said electronic circuitry and components switch means further includes dimmer circuitry and components.

19. The system of claim 1 wherein said power input to said circuitry is a DC power input.

20. The system of claim 19 wherein said three stage power factor correction microchip controller includes power detection means for end-of-lamp-life detection, a current sensing PFC section based on continuous, peak or average current sensing, and a low start up current of less than about 0.55 milliamps.

* * * * *